US010639647B2

(12) United States Patent
Meier

(10) Patent No.: US 10,639,647 B2
(45) Date of Patent: May 5, 2020

(54) CENTRIFUGE WITH A FEED DEVICE COMPRISING A FEED DIRECTION CONTROL AND METHOD OF LOADING A CENTRIFUGE WITH A FEED DEVICE COMPRISING A FEED DIRECTION CONTROL

(71) Applicant: Ferrum AG, Rupperswil (CH)

(72) Inventor: Daniel Meier, Therwil (CH)

(73) Assignee: Ferrum AG, Rupperswil (CH)

( * ) Notice: Subject to any disclaimer, the term of this patent is extended or adjusted under 35 U.S.C. 154(b) by 230 days.

(21) Appl. No.: 14/622,087

(22) Filed: Feb. 13, 2015

(65) Prior Publication Data

US 2015/0238977 A1 Aug. 27, 2015

(30) Foreign Application Priority Data

Feb. 26, 2014 (EP) ..... 14156830

(51) Int. Cl.
*B04B 3/02* (2006.01)
*B04B 11/06* (2006.01)
(Continued)

(52) U.S. Cl.
CPC ..... *B04B 3/02* (2013.01); *B04B 11/02* (2013.01); *B04B 11/06* (2013.01); *B04B 13/00* (2013.01); *B04B 15/06* (2013.01)

(58) Field of Classification Search
CPC ..... B04B 3/02; B04B 13/00; B04B 11/02; B04B 11/06; B04B 15/06; B04B 11/00; B04B 11/04
(Continued)

(56) References Cited

U.S. PATENT DOCUMENTS 2,167,837 A * 8/1939 Hall ..... B04B 11/02 137/502
2,828,021 A * 3/1958 Ernst ..... B04B 3/02 210/376
(Continued)

FOREIGN PATENT DOCUMENTS

CN 1036714 A 11/1989
CN 101987313 A 3/2011
(Continued)

OTHER PUBLICATIONS

EP 1468741 Description Espacenet Machine Translation.*
(Continued)

*Primary Examiner* — Charles Cooley
(74) *Attorney, Agent, or Firm* — Kilpatrick Townsend & Stockton LLP

(57) ABSTRACT

Pusher centrifuges having screen drums rotatable about axes of rotation are used for separating a mixture into solid cake and into liquid phase. Pusher centrifuges may further have pusher bases arranged in the screen drums and arranged to be movable to and fro alternately in a first pushing direction and a second pushing direction along the axis of rotation that are used in order for the solid cake to be alternately displaced along the axis of rotation. The mixture is introduced into a first empty space or into a second empty space using a feed device. The first empty space is established on a displacement of the solid cake by the pusher base in the first pushing direction and the second empty space is established on a displacement of the solid cake by the pusher base in the pushing direction opposite to the first pushing direction.

14 Claims, 5 Drawing Sheets

Figure 1:
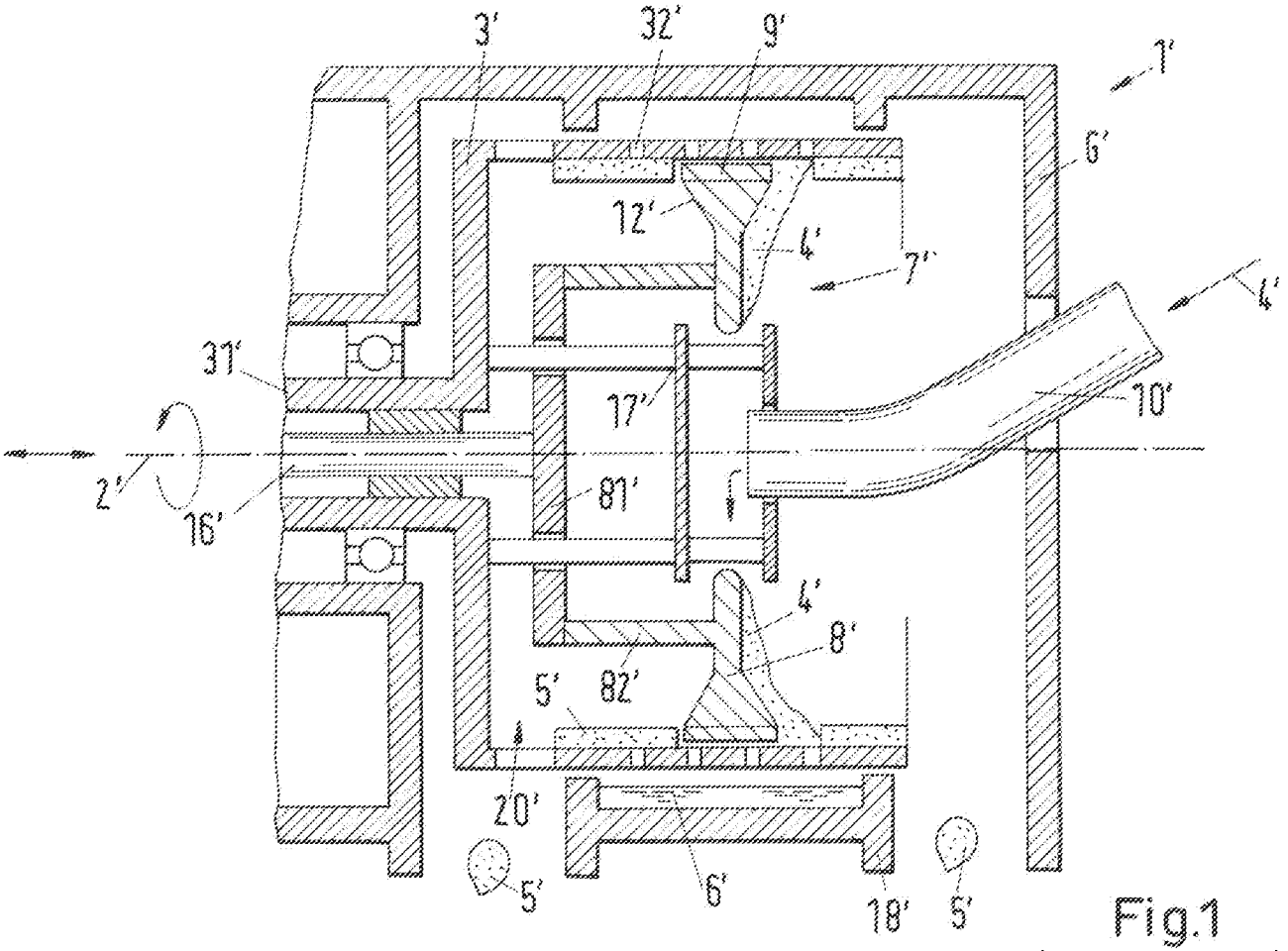
Fig.1 (Prior Art)

(51) Int. Cl.
*B04B 13/00* (2006.01)
*B04B 15/06* (2006.01)
*B04B 11/02* (2006.01)

(58) Field of Classification Search
USPC ..... 494/36; 210/360.1, 369, 376
See application file for complete search history.

(56) References Cited

U.S. PATENT DOCUMENTS

| | | | | | |
|---|---|---|---|---|---|
| 3,136,721 | A * | 6/1964 | Gooch | B04B 3/02 | 210/214 |
| 3,409,137 | A * | 11/1968 | Schneider | B04B 3/02 | 210/213 |
| 3,585,132 | A * | 6/1971 | Ruegg | B04B 3/02 | 210/376 |
| 3,989,185 | A | 11/1976 | Mercier | | |
| 4,217,226 | A * | 8/1980 | Kampeen | B04B 3/02 | 210/376 |
| 4,556,174 | A * | 12/1985 | Sieke | F15B 21/125 | 241/1 |
| 4,889,627 | A | 12/1989 | Sulzer-Escher | | |
| 4,957,475 | A * | 9/1990 | Kreill | B04B 1/20 | 494/53 |
| 5,085,443 | A * | 2/1992 | Richards | B04B 3/02 | 277/412 |
| 5,468,389 | A * | 11/1995 | Keller | B04B 3/02 | 210/360.2 |
| 7,017,756 | B2 * | 3/2006 | Reinach | B04B 3/02 | 210/369 |
| 7,025,211 | B2 * | 4/2006 | Reinach | B04B 3/02 | 210/369 |
| 7,032,759 | B2 * | 4/2006 | Reinach | B04B 3/02 | 210/369 |
| 10,363,500 | B2 * | 7/2019 | Keller | B01D 45/16 | |
| 2004/0206686 | A1 * | 10/2004 | Reinach | B04B 3/02 | 210/360.1 |
| 2004/0206687 | A1 * | 10/2004 | Reinach | B04B 3/02 | 210/360.1 |
| 2004/0206688 | A1 * | 10/2004 | Reinach | B04B 3/02 | 210/369 |
| 2004/0206689 | A1 * | 10/2004 | Reinach | B04B 3/02 | 210/369 |
| 2007/0123408 | A1 * | 5/2007 | Busch | B04B 3/04 | 494/45 |
| 2011/0097249 | A1 * | 4/2011 | Busch | B04B 3/04 | 422/533 |
| 2015/0238977 | A1 * | 8/2015 | Meier | B04B 3/02 | 494/36 |
| 2015/0367260 | A1 * | 12/2015 | Keller | B04B 3/02 | 210/360.2 |
| 2016/0318041 | A1 * | 11/2016 | Melling | B04B 5/005 | |

FOREIGN PATENT DOCUMENTS

| | | | | | |
|---|---|---|---|---|---|
| DE | 2332913 | A1 | 1/1975 | | |
| EP | 0341433 | A2 * | 11/1989 | B04B 1/20 | |
| EP | 06335309 | A1 | 1/1995 | | |
| EP | 1468741 | A1 | 10/2004 | | |
| EP | 1468741 | A1 * | 10/2004 | | |
| EP | 2913112 | A1 * | 9/2015 | B04B 3/02 | |
| EP | 1468742 | B1 * | 11/2016 | B04B 3/02 | |
| GB | 800319 | A * | 8/1958 | B04D 3/02 | |
| GB | 894443 | A * | 4/1962 | B01D 33/11 | |
| GB | 1315477 | A * | 5/1973 | B04B 11/04 | |
| GB | 1465807 | A * | 3/1977 | | |
| GB | 1465807 | A | 3/1977 | | |
| JP | 38009631 | | 6/1963 | | |
| JP | 5297477 | A | 8/1977 | | |
| JP | 5845760 | A | 3/1983 | | |
| JP | 2011136339 | A | 7/2011 | | |
| WO | 92/07659 | A1 | 5/1992 | | |

OTHER PUBLICATIONS

Search Report dated Jul. 7, 2014, from European Application No. 14156830.3 (9 pages).

English translation of the First Search Report from the State of Intellectual Property Office, P.R. China dated Mar. 29, 2018, for corresponding Application No. 201510074510.8, filed Feb. 12, 2015, 3 pages.

English translation of the First Office Action from the State of Intellectual Property Office, P.R. China dated Mar. 29, 2018, for corresponding Application No. 20150074510.8, filed Feb. 12, 2015, 4 pages.

First Office Action, and First Search Report from the State of Intellectual Property Office, P.R. China dated Mar. 29, 2018, for corresponding Application No. 201510074510.8, 5 pages.

* cited by examiner

CENTRIFUGE WITH A FEED DEVICE COMPRISING A FEED DIRECTION CONTROL AND METHOD OF LOADING A CENTRIFUGE WITH A FEED DEVICE COMPRISING A FEED DIRECTION CONTROL

CROSS-REFERENCE TO RELATED APPLICATIONS

This application claims priority to European Patent Application No. 14156830.3, filed Feb. 26, 2014, the disclosure of which is incorporated by reference herein.

BACKGROUND OF THE INVENTION

The invention relates to a centrifuge. in particular to a double-action pusher centrifuge, or to a single-stage or multistage pusher centrifuge, as well as to a feed redirection control for a centrifuge, and to a method of loading a centrifuge with a mixture or with a washing fluid.

Within the framework of this application, the invention will primarily be discussed for the example of the use of a double-action pusher centrifuge. It is understood in this respect that the invention can equally advantageously be used in any other centrifuge type, in particular also in single-stage or multistage pusher centrifuges, and in special cases even in scraper centrifuges, which are therefore all covered by the present invention.

Centrifuges are widespread in the most varied embodiments for the dehumidification of materials charged with liquids, that is of humid substances or humid substance mixtures, and are used in the most varied areas. Discontinuously operating centrifuges such as scraper centrifuges are thus, for example, preferably used for the dehumidification of very pure pharmaceutical products, whereas continuously operating pusher centrifuges are advantageously used in particular when large amounts of a solid-liquid mix are to be separated continuously. In this respect, depending on the demand, single-stage or multistage pusher centrifuges, so-called double-action pusher centrifuges, are advantageously used in practice.

In the different types of the last-named class of double-action pusher centrifuges, a solid-liquid mixture, for example a suspension or another humid substance mixture such as a humid salt or salt mixture, is supplied through an inflow pipe via a mixture distributor to a fast-rotating centrifuge drum comprising an operating basket which can be configured at least in part as a filter screen such that the liquid phase is separated by the filter screen due to the active centrifugal forces, whereas a solid cake is deposited in the interior at a drum wall of the centrifuge drum. The skilled person in this respect frequently uses the terms centrifuge drum, drum and operating basket, albeit not continuously as synonymous, with naturally drums built up of multiple parts also being known in which, for example, a removable filter basket or a removable filter cloth can be provided or the centrifugal drum itself can be integrally configured as a filter basket.

In this respect, a substantially disk-shaped, synchronously co-rotating pusher base is arranged in the rotating centrifuge drum, which is also simply called a drum in the following, and oscillates at a specific amplitude in the axial direction in the drum so that some of the dehumidified solid cake is pushed out at an end of the drum. On the opposite movement of the pusher base, a region of the operating basket adjacent to the pusher base is released which can then be loaded with new mixture again through the inlet pipe and via the mixture distributor. In this respect, depending on the type used, throughput quantities in an order of magnitude of up to 100 metric tons (tonnes) per hour or even more can be reached without problem using modern high-performance double-action pusher centrifuges, wherein drum diameters of up to 1000 mm and even larger are by all means customary and typical rotational frequencies of the drum can be reached of up to 2000 revolutions per minute and more in dependence on the drum diameter. As a rule, in this process, a larger drum diameter causes a smaller maximum rotational frequency of the drum due to the strong centrifugal forces which occur. The operating parameters such as the rotational frequency of the drum or of the operating basket, the quantity of mix supplied per unit of time or also the drum diameter and thus the diameter of the operating basket, or also the type of pusher centrifuge used can naturally also depend on the material to be dehumidified itself, on the content of liquid, etc.

In the known double-action pusher centrifuges, the mixture typically moves via a standing inlet pipe and a mixture distributor into the center of the centrifuge drum, with the mixture distributor rotating synchronously with the centrifuge drum. The mixture can be supplied in interaction with the mixed distributor by a pusher base, which is arranged at the center of the operating basket, which oscillates along the longitudinal axis of the centrifuge drum and which can be operationally fixedly connected to the mixture distributor, alternately to the front or rear drum half. Two inlet zones are thereby present so that correspondingly larger quantities of mixture can be processed per unit of time. A predefinable portion of the solid cake is in this respect transported by the pusher base to the respective end of the drum and is discharged via a collection channel.

A known double-action pusher centrifuge which works in accordance with the previously described principle is described in detail, for example, in EP 0 635 309 B1. The advantages with respect to conventional single-stage or multistage pusher centrifuges are obvious. The double inlet zone is inter alia to be named here, whereby a considerably increased liquid throughput capacity is achieved so that mixtures having lower inlet concentrations, i.e. having higher liquid contents, can be processed, with simultaneously higher total inflow quantities of mixture being able to be processed. Furthermore, twice the solid conveying capacity results with the same number of strokes and thus specifically less transport work. In this respect, the space requirement corresponds to that of normal pusher centrifuges of the same construction size.

Typical areas of use for double-action pusher centrifuges are inter alia products which are easy to dehumidify such as sea salt, where in particular the double utilization of the pushing movement comes fully into operation. A further typical area of application includes products which are difficult to filter or mixtures having low inlet concentrations (that is with high liquid contents). Higher liquid throughput capacities in comparison with conventional pusher centrifuges have a particularly positive effect here. Smaller inlet concentrations or higher suspension quantities can be processed without a glut occurring.

However, the known pusher centrifuges also have various serious disadvantages. Even though lower inlet concentrations can be processed with the known double-action pusher centrifuges than with conventional single-stage or multistage pusher centrifuges, the inlet concentration of the mixture to be processed may not be as small as desired. I.e. if the proportion of liquid in the mixture is too high, for example amounts to 50% or 70% or 80% or even more than 90% liquid phase, the mixture has to be prethickened in more or less complex processes. If the liquid content is too high, namely a uniform distribution of the mixture to be dried is made increasingly more difficult over the periphery of the screen drum. This can result, on the one hand, in very harmful vibrations of the screen drum and thus in premature wear of bearings and the drive; in the worst-case scenario even in a safety problem in operation. On the other hand, a solid cake distributed unevenly over the periphery of the screen drum effects problems in washing. Static thickeners, curved screens or the very well-known hydrocyclones are therefore available for pre-dewatering, for example. It is obvious that the use of such pre-dewatering systems is very complex and thus expensive both from a technical process aspect and an apparatus aspect.

A further serious disadvantage in the processing of mixtures of small inlet concentrations comprises the fact that practically the total quantity of liquid, which is supplied with the mixture, has to be accelerated to the full peripheral speed before it is separated by the filter screen of the screen drum. The same applies to the smallest particles in the mixture which are likewise to be deposited from the solid cake through the screen. This is extremely unfavorable energetically and has a very negative influence on the operating behavior of the centrifuge.

But the centrifuges known from the prior art also show considerable disadvantages in part even in the processing of mixtures having considerably higher solid concentrations. The mixture introduced through the inlet pipe into the mixture distributor is thus accelerated to the full peripheral speed of the drum in a very short time on impacting the screen drum. This can in particular inter alia result in grain fracturing with sensitive substances. This means that, for example solid grains which are distributed in a suspension supplied to the centrifuge, burst into smaller pieces in an uncontrolled manner on the abrupt acceleration process, which can have negative effects on the quality of the produced solid cake if, for example, the particle size of the grains in the end product plays a role.

The applicant had already recognized some of the previously described problems, but also further problems, earlier and had proposed corresponding solutions in EP 1 468 741 A1, for example.

For the better understanding of the present invention, the known solution in accordance with EP 1 468 741 A1 will be briefly explained in the following with reference to FIG. 1. In this respect, to distinguish the present invention from the solution known from the prior art in accordance with FIG. 1, the reference numerals of FIG. 1 are provided with a dash, while the reference numerals of features of embodiments in accordance with the invention in accordance with FIG. 2 to FIG. 6*c* have no dash.

The centrifuge in accordance with FIG. 1 shows in section in a schematic representation major components of a known double-action pusher centrifuge. The double-action pusher centrifuge known e.g. from EP 1 468 741 A1, which is marked as a whole in the following by the reference numeral 1', comprises in a manner known per se an operating basket 3' which can rotate via a drum axle 31' about an axis of rotation 2' and which is accommodated in a housing G'. The drum axle 31' is operationally connected to a drum drive, not shown, so that the operating basket 3' can be set into fast rotation about the axis of rotation 2' by the drum drive. The operating basket 3' in this respect has screen openings 32' through which the liquid phase 6' of a mixture 4' which is applied to an inner peripheral surface 20' of the operating basket 3' can be led off outwardly into a collection apparatus 18' in a known manner on a fast rotation by the centrifugal forces which occur. The mixture 4' applied to the inner peripheral surface 20' of the operating basket 3' is thus separated by the prevailing very high centrifugal forces into a solid cake 5' which is deposited on the inner peripheral surface 20' of the operating basket 3' and into the liquid phase 6' which can be led off from the operating basket 3' through the screen openings 32'.

A mixture distributor 7' is arranged within the operating basket 3' and allows mixture 4' to be distributed over the inner peripheral surface 20' of the operating basket 3', with the mixture distributor 7' comprising an inlet pipe 10' and a pusher base apparatus 8' having a pusher base plate 81'.

The mixture 4' moves via the inlet pipe 10' into the inlet device 17' of the mixture distributor 7' in the operating state and can then be supplied alternately to the front or rear half of the operating basket 3' due to an oscillatory movement of the pusher base apparatus 8'. The inlet device 17' is in this respect preferably rigidly connected by fastening means to the operating basket 3' and therefore rotates synchronously with the operating basket 3' and the mixture distributor 7'. The oscillatory movement which will be described in more detail further below is, however, only carried out by the mixture distributor 7' with its components, i.e. with the pusher base plate 81', the connection element 82', the pusher base apparatus 8' and the outer ring region 9'. There is thus an oscillatory relative movement between the oscillatory mixture distributor 7' and the inlet device 17', which is unmovable in the axial direction, or the inlet pipe 10', which is unmovable in the axial direction, in the operating state such that the mixture 4' can alternately be supplied to the front or rear half of the operating basket 3'.

The pusher base apparatus 8' is operationally fixedly connected to the pusher base plate 81' via a connection element 82'. The pusher base apparatus 8' is in this respect preferably configured in the form of a circular disk having an outer ring region 9', wherein the ring region 9' is formed and arranged at a peripheral region of the pusher base apparatus 8' such that the solid cake 5' deposited in the operating basket 3' can alternately be pushed in both directions of the axis of rotation 2' by the ring region 9'. The pusher base plate 81' is likewise preferably configured as an annular sheath 81', but can also be designed in the form of a spoked wheel 81' or in any other suitable shape. The connection element 82' which operationally fixedly connects the pusher base plate 81' to the pusher base apparatus 8' is made up, for example, of a plurality of stays 82' which preferably, but not necessarily, extend along the axis of rotation 2' or can be designed as compact or non-compact drums 82', for example as perforated drums 82' or in any other suitable form.

The pusher base plate 81' is coupled by means of a pusher axle 16' to a pusher apparatus, not shown, having a redirection control, so that the pusher base plate 81' can be set into an oscillatory movement having a predefinable stroke in the direction of the axis of rotation 2' by the connection element 82' and the pusher base apparatus 8'. The solid cake 5' deposited on the peripheral surface of the operating basket 3' can be displaced by the outer ring region 9' alternately in both directions of the axis of rotation 2' by the oscillatory movement of the pusher base apparatus 8' so that the solid cake can be transported in an axial direction to the respective end of the operating basket 3' by the outer ring region 9' and can be led off from the double-action pusher centrifuge 1' separated from the liquid phase 6' via a discharge opening 19'.

The major aspect of this earlier invention of the applicant is in this respect that the pusher base apparatus 8' is configured in a predefinable region in the form of acceleration surfaces 12' such that the mixture 4' introduced by the inlet pipe 10' can be accelerated to a predefinable peripheral speed before reaching the operating basket 3'.

Since in this solution in accordance with EP 1 468 741 A1 the pusher base apparatus 8' has acceleration surfaces 12' inclined toward the radial direction, a mixture 4' introduced into the mixture distributor 7' through the inlet pipe 10' does not directly impact the operating basket 3'. The incoming mixture 4' is rather applied to the acceleration surfaces 12' which are inclined toward the radial direction. A slowed-down acceleration of the newly introduced mixture 4' to the peripheral speed of the operating basket 3' is thereby achieved, whereby in particular grain fracture and other damaging influences such as occur on the abrupt acceleration in the double-action pusher centrifuges known from the prior art can be prevented. A bursting of solid grains contained in the mixture in such a double-action centrifuge 1' can thus be avoided because the acceleration process can be controlled via the predefinable inclination angle of the acceleration surface 12', i.e. the acceleration itself can be set, for example, by a suitable choice of the inclination angle of the acceleration surface 12'. The quality of the produced solid cake 5' can thereby be considerably increased, in particular in products in which, for example, the particle size or the shape of the grains play a role in the end product. In very specific cases, it is even possible to manufacture products of different quality in one and the same double-action pusher centrifuge 1' in one workstep, i.e. substantially simultaneously, in that, for example, the inclination angle of the acceleration surfaces 12' arranged at both sides at the pusher base apparatus 8' is selected as different.

Although the previously described double-action pusher centrifuge in accordance with EP 1 468 471 A1 has proved itself in practice for what is now many years and still continues to provide exceptional service for many applications, experience has nevertheless shown that further improvements may be necessary, in particular with special demands, to further optimize the working results. This in particular relates to the filling of the centrifuge as such, but also the washing of the solid cake brings along further potential for improvement. It has been found in practical use that e.g. an optimization of the metering is desirable in specific cases in the charging of the product stream. The same applies analogously to the washing procedure which could be considerably improved by a more direct metering of the supply of the washing liquid.

The construction of EP 1 468 741 A1 comprising the mixture distributor 7', the inlet device 17 and comprising the acceleration surfaces 12' at the pusher base apparatus 8' in accordance with FIG. 1 is relatively complex in construction such that it may be desirable in specific cases to dispense with such a complex construction of the mixture distributor 7' either fully or at least partly or to keep it in full or in parts, but simultaneously to further improve its function by additional construction or technical process measures.

It is therefore the object of the invention to propose an improved double-action pusher centrifuge which largely avoids the disadvantages resulting from the prior art.

The centrifuge, in particular the double-action pusher centrifuge, or the single-stage or multistage pusher centrifuge, in accordance with the present invention comprises a screen drum rotatable about an axis of rotation for separating a mixture into a solid cake and into a liquid phase as well as a pusher base apparatus which is arranged in the screen drum and which is arranged movable to and fro alternately in a first pushing direction and in a second pushing direction along the axis of rotation so that the solid cake is alternately displaceable along the axis of rotation. The mixture can be introduced into a first empty space or into a second empty space by means of a feed device, which first empty space can be established on a displacement of the solid cake by the pusher base apparatus in a first pushing direction and the second empty space can be established on a displacement of the solid cake by the pusher base apparatus in the pushing direction opposite to the first pushing direction. In accordance with the invention, the feed device comprises a feed redirection control and a mixture supply such that the mixture can be supplied by means of the feed redirection control via the mixture supply to the first empty space or to the second empty space in accordance with a predefinable scheme.

It is important for the invention that the feed device, which can comprise an inlet pipe known per se in practice, comprises a feed redirection control and is in operational communication therewith such that at least the mixture and/or in specific embodiments also another fluid, e.g. a washing fluid, can be introduced into the interior of the screen drum and can be distributed in the screen drum and thus e.g. the mixture to be dehumidified can be supplied directly and in accordance with a predefinable scheme and in predefinable quantities into the first empty space or second empty space of the double-action pusher centrifuge produced by the pusher base at an inner peripheral surface of the screen drum in the operating state.

It is thus possible for the first time by the present invention to apply the mixture to be dehumidified metered in predefinable quantities and at predefinable times or in predefinable time intervals ideally in dependence on the respective relevant conditions or parameters onto the inner peripheral surface of the screen drum for dehumidification. For example, with one and the same centrifuge, a mixture charged with a great deal of liquid or also an already largely pre-dehumidified mixture can thus be ideally processed by a double-action pusher centrifuge in accordance with the invention without construction adaptations previously having to be made at the centrifuge or at its additional units. The same also applies, for example, to the washing process which can for the first time be adapted with a previously unknown flexibility to the specific conditions of any application or of any material to be processed. For this purpose, the centrifuge in accordance with the invention in accordance with the following detailed description comprises corresponding devices for loading with the mixture to be dehumidified, usually a suspension in practice, or also devices for washing the solid cake with a washing liquid. In this respect, corresponding units can naturally also be provided for flushing the centrifuge which the skilled person is aware of in principle.

So that the feed device of the present invention can develop its full flexibility, sensors known per se, feelers, optical objectives or other sensors or detectors known per se can be provided at a double-action pusher centrifuge for measuring, controlling or regulating the supply of the media to be processed such as suspensions, washing fluids or cleaning fluids to be dehumidified or other media to be processed and e.g. suitable valves, pumps, sluices, etc. can be controlled or regulated by them such that the materials to be processed can be supplied flexibly and ideally to the screen drum in accordance with the required demands.

The feed device or at least some of its components is/are in this respect advantageously provided at a front plate of the centrifuge and particularly preferably projects through the pusher base into the interior of the screen drum of the centrifuge.

The feed device can in this respect comprise one, more or even a plurality of inlet pipes and/or feed redirection controls at or in which one or more rotating or partly rotating or pulsating metering devices in the form of metering pistons, metering bushes or differently designed metering units can be provided in the operating state.

The one or more pulsating, rotating or partly rotating components or components metering in a different manner of the feed redirection control in accordance with the invention thus serve or serves above all, but not only, for the defined charging of the product stream comprising the mixture to be dehumidified and/or for washing the solid cake and/or, however, also for flushing the front or rear chambers of the rear chambers of the centrifuge.

If the metering device is e.g. a metering piston or a metering bush or another metering unit, it can, for example, have an angled, oval or circular cross-section. It can, however, also be configured as a flat pusher in a cylindrical, cubic or spherical manner and thus serves for the direct feed or non-feed of the medium to be fed into the screen drum.

It is in this respect self-explanatory that the feed device or its components can be manufactured from any suitable material and can be manufactured in dependence on the demands in accordance with manufacturing processes known per se and can possibly e.g. also be suitably treated at the surfaces so that required demands on specific material properties such as hardness, strength, structural changes, the surface roughness, etc. can be ideally set.

The drive and/or the control and/or the regulation of the feed device or of its components can take place by suitable drives which are provided directly at the corresponding components to be driven or which can also be provided remote from the components, e.g. in corresponding drive units outside the centrifuge, which can then be connected in a manner known per se via suitable connections such as pressure lines, electrical connections, radio connections or any other suitable operational and/or signal connection to the component to be operated.

In an embodiment of a double-action pusher centrifuge in accordance with the invention particularly important in practice, the feed device comprises an inlet pipe having an inlet pipe axis and the feed redirection control comprises a metering device which is provided at the inlet pipe and with which the mixture supply can be manipulated in accordance with a predefinable scheme such that a supply of the mixture into the first empty space or into the second empty space is suppressed. This means that the supply of the mixture into the first empty space or into the second empty space is no longer controlled so-to-say passively and inflexibly by the movement of the pusher base alone, but can rather be flexibly controlled and/or regulated actively and directly by the feed redirection control in accordance with a predefined scheme in the pusher centrifuge in accordance with the invention.

The metering device can specifically be a metering piston arranged at least partly in the inlet pipe or can alternatively or additionally be a metering bush arranged at least partly outwardly at the inlet pipe.

For the setting and influencing of the fluid stream, the metering device can be arranged displaceable along the inlet pipe axis or rotatable about the inlet axis or can be configured in any other suitable manner which allows as desired the direct control and/or regulation of the fluid stream, that is of the mixture to be dehumidified or separated, the washing liquid, the cleaning liquid or any other material to be processed.

In this respect, the mixture supply can be an integral component of the inlet pipe and can preferably comprise a first supply opening, not movable with respect to the inlet axis, for the supply of the mixture or of another fluid to be processed into the first empty space and a second supply opening, not movable with respect to the inlet axis, for the supply of the mixture or of another fluid to be processed into the second empty space.

In another specific embodiment, the mixture supply can alternatively or simultaneously be an integral component of the metering device and can preferably comprise a first supply opening, movable with the metering device with respect to the inlet axis, for the supply of the mixture or of another fluid to be processed into the first empty space and a second supply opening, movable with the metering device with respect to the inlet axis, for the supply of the mixture or of another fluid to be processed into the second empty space.

As already mentioned, a plurality of mixture supplies or a plurality of metering devices can also advantageously be provided, with the feed device preferably being able to comprise a plurality of inlet pipes with a feed redirection control and a mixture supply such that the mixture or another fluid to be processed can be supplied to the first empty space or to the second empty space in accordance with a predefinable scheme. Wherein in a specific embodiment, the mixture or another fluid to be processed can be supplied separately by the feed redirection control to at least some of the inlet pipes or to a group of inlet pipes.

As already stated in more general terms further above, the feed redirection control can in particular be able to be manipulated by means of a mechanical drive or by means of an electrical drive or by means of a hydraulic drive or by means of a pneumatic drive and preferably by means of a control unit in accordance with a predefinable scheme and can specifically be able to be controlled or regulated by means of a programmable data processing system.

In this respect, it is naturally possible that, with a centrifuge in accordance with the invention, a washing device is also provided for washing the solid cake by means of a washing fluid, wherein the washing device can preferably be identical to the feed device or to part of the feed device, wherein, for the controlled supply of the mixture or of the washing fluid or of another fluid to be processed, a feed metering unit can be used which is provided inside or outside the centrifuge and which in the simplest case is, for example, a shut-off valve or a metering valve so that a predefinable quantity of the mixture or a predefinable quantity of the washing fluid or of another fluid to be processed can be supplied to the feed device.

In this respect, an inlet disk known per se is provided, preferably at the inlet pipe, for the better channeling of the medium to be introduced into the screen drum or for the controlled supply of the mixture into a predefinable region of the screen drum.

The invention furthermore relates to a feed redirection control and to a method of loading a centrifuge, in particular a double-action pusher centrifuge, or a single-stage or multistage pusher centrifuge in accordance with the present description.

Although it is one of the important advantages of the present invention that it is possible to dispense with many relatively complex and/or expensive components such as are necessary for various reasons in known centrifuges in most application areas with a centrifuge in accordance with the invention because the problems known from the prior art are prevented by the feed redirection control of the present invention, it has been found with specific applications that it can nevertheless in particular be of advantage to use the feed redirection control in accordance with the invention in combination with the acceleration surfaces in accordance with EP 1 468 741 A1, whereby an even more optimum, above all more gentle, processing of the mixture to be dehumidified is possible.

Analogously to EP 1 468 741 in accordance with FIG. 1, the pusher base apparatus of a centrifuge in accordance with the invention can also have an acceleration surface inclined toward the radial direction which is not shown explicitly for reasons of clarity in the drawings relating to the examples in accordance with the invention in accordance with FIG. 2 to FIG. 6*c*, but which can be transferred from FIG. 1 to a centrifuge in accordance with the invention without problem for the skilled person.

A mixture introduced through the feed device does not directly impact the screen drum due to the provision of the inclined acceleration surfaces. The incoming mixture is rather applied to the acceleration surfaces which are inclined toward the radial direction. A slowed acceleration of the newly introduced mixture to the peripheral speed of the screen drum is thereby achieved, whereby in particular grain fracture and other damaging influences such as occur on the abrupt accelerations in other centrifuges known from the prior art can be prevented. A bursting of solid grains contained in the mixture can thus be avoided by the centrifuge in accordance with the invention because the acceleration process can be controlled via the predefinable inclination angle of the acceleration surfaces, i.e. the acceleration itself can be set by a suitable choice of the inclination angle of the acceleration surface. The quality of the solid cake produced can thereby in particular be considerably increased in products in which, for example, the particle size or the shape of the grains in the end product plays a role. In very specific cases, it is even possible to manufacture products of different quantity in one and the same centrifuge, in particular on the use of a double-action pusher centrifuge in one workstep, i.e. substantially simultaneously, in that, for example, the inclination angle of the acceleration surfaces arranged at both sides at the pusher base apparatus is selected as different.

In a centrifuge in accordance with the invention, in particular with a double-action centrifuge, the screen drum can be configured in a manner known per se as a skeleton-type support drum which is lined at its periphery with special filter films for forming the corresponding screen surfaces, i.e. the skeleton-type support drum can, for example, be configured with one or more filter screens having filter openings of different size or of the same size for separating the liquid phase.

A mixture distributor can also optionally be arranged within the screen drum and allows mixture to be distributed over the peripheral surface of the screen drum, with the mixture distributor preferably comprising an inlet device and a pusher base apparatus with a pusher base plate.

The inlet device is in this respect rigidly coupled to the screen drum in a preferred embodiment and therefore rotates synchronously with the screen drum and the mixture distributor. The oscillatory movement, however, is only executed by the mixture distributor with its components, i.e. with the pusher base plate, with the connection element, with the pusher base apparatus and with the outer ring region. There is thus an oscillatory relative movement between the oscillating mixture distributor and the inlet device unmovable in the axial direction in the operating state so that the mixture can alternately be supplied to the front or rear half of the screen drum.

The pusher base apparatus, which can be operationally fixedly connected to the pusher base plate in a specific embodiment variant, is in this respect preferably configured in the form of a circular disk having an outer ring region, wherein the ring region is configured and arranged at a peripheral region of the pusher base apparatus such that the solid cake deposited in the screen drum can be displaced alternately in both directions of the axis of rotation by the ring region.

The pusher base plate can be coupled to a pusher apparatus with a redirection control in a manner known per se by means of a pusher axle in the case of a double-action pusher centrifuge so that the pusher base apparatus can be set into an oscillatory movement with a predefinable stroke in the direction of the axis of rotation. The solid cake deposited on the peripheral surface of the screen drum can be displaced alternately in both directions of the axis of rotation by the outer ring region due to the oscillatory movement of the pusher base apparatus so that the solid cake can be transported by the outer ring region in the axial direction to the respective end of the screen drum and can be led out of the double-action pusher centrifuge separated from the liquid phase via a discharge opening.

It is important in this respect in the corresponding specific embodiment of the invention that the pusher base apparatus is configured in a predefinable region in the form of acceleration surfaces such that the mixture introduced by the feed device can be accelerated to a predefinable peripheral speed before reaching the screen drum.

For this purpose, with a double-action pusher centrifuge, the mixture is alternately supplied from the feed device to a respective one side of the pusher base apparatus. If the mixture cannot already be pre-accelerated to a predefinable peripheral speed in the feed device, the mixture moves onto a corresponding surface of the pusher base apparatus substantially under the effect of gravity and finally reaches the acceleration surface inclined with respect to the radial direction at a predefinable inclination angle. The mixture flows over or along the acceleration surface and thus arrives on the peripheral surface of the screen drum. The mixture here moves into the empty space at the peripheral surface of the screen drum created by the oscillation movement of the pusher base apparatus and is accelerated to the rotational speed of the screen drum. The liquid phase contained in the mixture is led out of the screen drum through the screen openings due to the enormously high centrifugal forces which act on the mixture deposited in the empty space.

Since the acceleration surface is inclined with respect to the radial direction, the flow speed can be directly varied in comparison with the speed in freefall of the mixture in the direction toward the peripheral surface in the region of the acceleration surface so that the mixture can be accelerated gradually in the region of the acceleration surfaces as it increasingly approaches the outer ring region. This means that the mixture is accelerated in the region of the acceleration surfaces of the double-action pusher centrifuge in accordance with the invention in a particularly gentle manner gradually to a predefinable peripheral speed in order then finally to reach the full rotational speed of the screen drum on reaching the peripheral surface.

The value of the inclination angle of the acceleration surface toward the radial direction can in this respect, for example, lie between 0° and 90°, specifically between 10° and 30° or between 30° and 60°, in particular between 60° and 70°, but preferably between 55° and 75°. It is naturally also specifically possible that the value of the inclination angle is larger than 70° and can even be close to 90°. It can very generally be stated that as a rule an angle relative to the radial direction which is rather not too acute is of advantage, with an optimum value of the corresponding inclination angle being determined inter alia by the value of the angle of static friction of the product to be dewatered. In this respect, the acceleration surfaces can either only extend over a part region of the pusher base apparatus or also over the entire radial height of the pusher base apparatus, with the pusher base apparatus being able to be built up in dependence on the requirement fully or partly as a substantially hollow frame structure or fully or partly of solid material. It is naturally possible that the two acceleration surfaces can have the same or different inclination angles.

In an embodiment of a centrifuge in accordance with the invention of particular relevance for practice, the acceleration surface is configured as a filter screen for separating liquid phase from the mixture. In this respect, both acceleration surfaces are preferably configured as a filter screen. Only one acceleration surface can naturally also be configured as a filter screen or the two acceleration surfaces can each have differently configured filter screens. In this respect, the two different filter screens can be made up, for example, from different materials or the size of the filter pores can differ. It is thereby possible to produce two different solid cakes of different quality, i.e. having different properties, from the same mixture in one and the same workstep.

The acceleration surface can in particular be arranged in an embodiment especially important for practice as a filter screen on a skeleton-type support body which can be equipped with special filter films for forming the filter screen, i.e. the skeleton-type support body can, for example, be equipped with one or more filter screens which may be able to have filter openings of different sizes for separation in different stages.

In this respect, wedge wire screens or screen plates, for example, among others can be considered very generally as filter screens. The filter screens can in this respect advantageously be provided in various manners with filter openings of different sizes. In particular the previously mentioned screen plates can inter alia be punched, drilled, lasered, perforated by electron beam or cut by water jets, with generally other techniques also being able to be considered. The screens can in this respect be produced in dependence on the demand from different materials, in particular corrosion-resistant materials, such as plastic, composite materials or different steels such as 1.4462, 1.4539 or 2.4602 or can be produced from other suitable materials. For protection against wear, the filter screens can furthermore be provided with suitable coatings, for example with hard chromium layers, tungsten carbide (WC), ceramics or can be otherwise toughened. The thickness of the filter plates in this respect typically amounts to 0.2 mm to 5 mm, with very different plate thicknesses also being possible.

The feed device can in particular comprise an inlet funnel for pre-accelerating the mixture for processing particularly sensitive mixtures. The mixture can thereby already be pre-accelerated to a predefinable rotational speed before the introduction into the mixture distributor and can thus be treated even more gently. In this respect, the rotational speed to which the mixture can already be pre-accelerated in the inlet funnel is, for example, predefinable by a selection of the size and/or of the opening angle of the inlet funnel.

In this respect, the inlet funnel can also be rotatably arranged about a separate drive axle independently of the mixture distributor and can be configured and arranged rotatable about the drive axle by means of a drive at a predefinable rotational speed. The pre-acceleration can thereby be freely selected by the setting of the rotational speed of the drum independently of the geometry of the inlet funnel. Suitable devices for controlling and/or regulating can in particular be provided so that, for example, the rotational speed of the drive is also freely variable during operation. The quality of the solid cake can thus, for example, be adapted in operation or a different product quality can be manufactured from one mixture, for example, by a suitable control and/or regulation of the rotational speed of the drive and thus of the inlet funnel to the right and left of the pusher base apparatus in each case in one and the same double-action pusher centrifuge.

The inlet funnel can advantageously also be configured as a prefilter screen for preseparation of liquid phase from the mixture, with preferably collection means being provided for collecting and leading off the liquid phase from the prefilter screen. Even mixtures with a very high liquid proportion can thereby be processed without problem. The preseparation of the liquid phase as early as in the inlet funnel furthermore has the huge advantage that this part of the liquid phase is no longer accelerated to the very high rotational speed of the screen drum, which inter alia has a particularly favorable effect on the energy consumption of the double-action pusher centrifuge.

In this respect, both the filter screen of the acceleration surfaces and the prefilter screen can be configured as a two-stage screen having a coarse filter and a fine filter. The mixture can thereby be filtered in two stages in the region of the acceleration surface and/or in the inlet funnel. The first filter stage in this respect forms a coarse filter which holds back particles contained in the mixture which are larger than the filter openings of the coarse filter. The fine filter holds back correspondingly finer particles, whereas at least a portion of the liquid phase as well as very small particles, which likewise have to be removed, can be led off directly. The configuration as a two-stage screen in particular has the advantage that the fine filter is not mechanically strained so much by large and/or heavy particles which are contained in the incoming mixture so that the fine filter can, for example, have very small pores for filtering very small particles and can in particular also be produced from mechanically less resistant materials.

In another embodiment variant of the centrifuge in accordance with the invention, the mixture distributor comprises a pre-acceleration funnel which extends in a substantially flaring manner in the direction toward the feed device.

The value of the opening angle of the inlet funnel and/or the value of the pre-acceleration angle of the pre-acceleration filter can in this respect lie, with respect to the axis of rotation, for example, between 0° and 45°, specifically between 0° and 10° or between 10° and 45°, in particular between 25° and 45°, preferably between 15° and 35°. It is specifically naturally also possible that the value of the opening angle and/or of the pre-acceleration angle is greater than 45°. It can very generally be stated that as a rule, with respect to the axis of rotation, a rather acute angle is of advantage, with an ideal value of the corresponding opening angle and/or of the pre-acceleration angle being determined inter alia by the value of the angle of static friction of the product to be dewatered.

In this respect, the pre-acceleration funnel can also be configured in an analog manner to the inlet funnel as a pre-acceleration screen, wherein collection devices for leading off liquid phase can be provided at the mixture distributor.

In an embodiment of particular importance for practice, the inlet funnel and/or the pre-acceleration funnel can be configured as a skeleton-type support body which can be configured with special filter films for forming the prefilter screen and/or the pre-acceleration screen, i.e. the skeleton-type support body can, for example, be equipped with one or more filter screens which may be able to have filter openings of different sizes for separation in different stages.

In this respect, wedge wire screens or screen plates, for example, among others can be considered very generally as filter screens. The filter screens can in this respect advantageously be provided in various manners with filter openings of different sizes. In particular the previously mentioned screen plates can inter alia be punched, drilled, lasered, perforated by electron beam or cut by water jets, with generally other techniques also being able to be considered. The screens can in this respect be produced in dependence on the demand from different materials, in particular corrosion-resistant materials, such as plastic, composite materials or different steels such as 1.4462, 1.4539 or 2.4602 or can be produced from other suitable materials. For protection against wear, the filter screens can furthermore be provided with suitable coatings, for example with hard chromium layers, tungsten carbide (WC), ceramics or can be otherwise toughened. The thickness of the filter plates in this respect typically amounts to 0.2 mm to 5 mm, with very different plate thicknesses also being possible.

The pre-acceleration funnel can in particular also be configured and arranged such that the pre-acceleration funnel is rotatable by means of a rotational drive about an axis of rotation at a predefinable speed of rotation.

In this respect, both the inlet funnel and the pre-acceleration funnel preferably extend at a substantially constant opening angle in a flaring manner in the direction toward the pusher base apparatus or toward the feed device. The value of the pre-acceleration angle of the pre-acceleration funnel can in this respect, with respect to the axis of rotation, lie between 0° and 45°, for example, particularly between 0° and 10°, or between 10° and 45°, in particular between 25° and 45°, preferably between 15° and 35°. It is specifically naturally also possible that the value of the pre-acceleration angle is greater than 45°. It can very generally be stated that as a rule, with respect to the axis of rotation, a rather acute angle is of advantage, wherein an ideal value of the corresponding pre-acceleration angle is inter alia determined by the value of the static friction angle of the product to be dewatered.

For specific applications, for example in dependence on the properties of the mixture to be dewatered, the inlet funnel and/or the pre-acceleration funnel can, however, also have a curved extent in a predefinable region, with the opening angle of the inlet funnel and/or of the pre-acceleration angle of the pre-acceleration funnel being able to be enlarged or reduced in size.

In particular, but not only, when the inlet funnel is configured as a prefilter screen for preselecting liquid phase, it may be of particular advantage if the inlet funnel has a curved extent and the opening angle of the inlet funnel enlarges or reduces in size in the direction toward the pusher base apparatus. It is namely known that different products can be dewatered to different degrees under otherwise equal operating conditions of the double-action pusher centrifuge, in dependence, for example, on the grain size and/or on the viscosity and/or on other properties or parameters such as the temperature of the mixture.

If, for example, a mixture is present which can be dewatered relatively easily under given operating parameters, it is of advantage that the inlet funnel or the prefilter screen has a curved extent, with the opening angle of the prefilter screen increasing in size in the direction toward the pusher base apparatus. This means that the inlet funnel or the prefilter screen flares in the direction toward the pusher base apparatus in a similar manner to the horn of a trumpet. The drive force at which the mixture is accelerated from the inlet funnel thus becomes disproportionately larger as the distance from the pusher base apparatus increases so that the mixture which can already be dewatered to a relatively large extent in the prefilter screen and thus shows poor sliding properties in the prefilter screen can leave the prefilter screen faster than, for example, with a prefilter screen expanding substantially conically at a constant opening angle.

On the other hand, mixtures can also be present which are relatively difficult to dewater under given operating conditions. It is recommended in this case to use an inlet funnel or a prefilter screen having a curved extent, with the opening angle of the prefilter screen reducing in size in the direction toward the pusher base apparatus. This has the consequence that the output force at which the mixture is accelerated out of the inlet funnel increases more slowly as the spacing from the pusher base apparatus reduces than with an inlet funnel flaring conically at a substantially constant opening angle. A specific congestion effect thereby arises in the pre-acceleration screen so that the mixture remains longer in the prefilter screen and can therefore be dewatered to a higher degree in the prefilter screen.

In a very analog manner to what has previously been said, the pre-acceleration funnel can naturally also have a curved extent, with the pre-acceleration angle of the pre-acceleration funnel increasing or reducing in size in the direction toward the feed device.

The advantages previously explained in connection with the curved inlet funnel and its operation can be transferred in an analog manner to a curved pre-acceleration funnel without problem for the skilled person and therefore do not have to be repeated here.

It is self-explanatory that the features of the particularly preferred embodiment variants of a centrifuge in accordance with the invention previously described by way of example can also be combined as desired in an advantageous manner depending on the demand.

Figure 2:
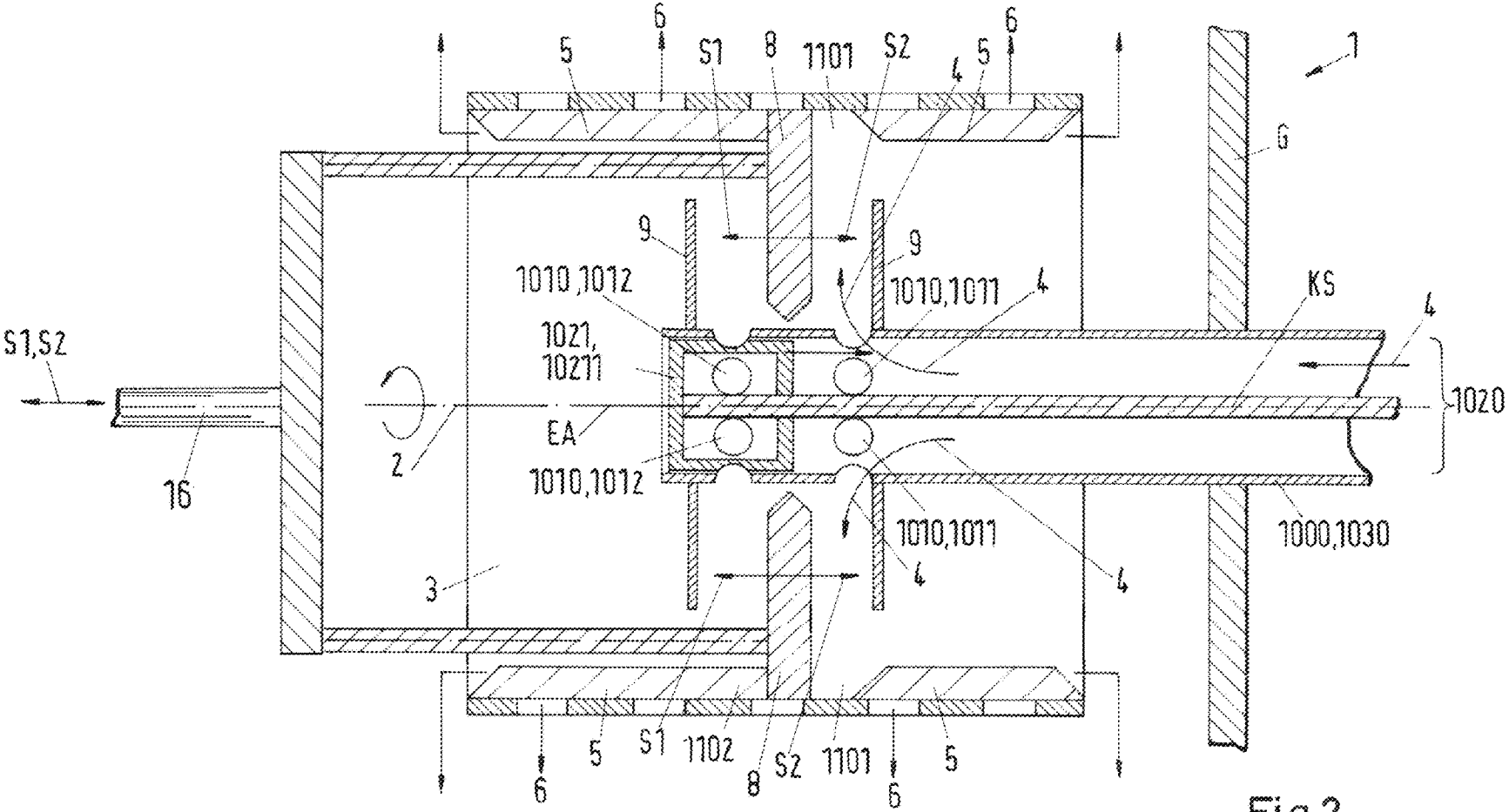
Figure 3:
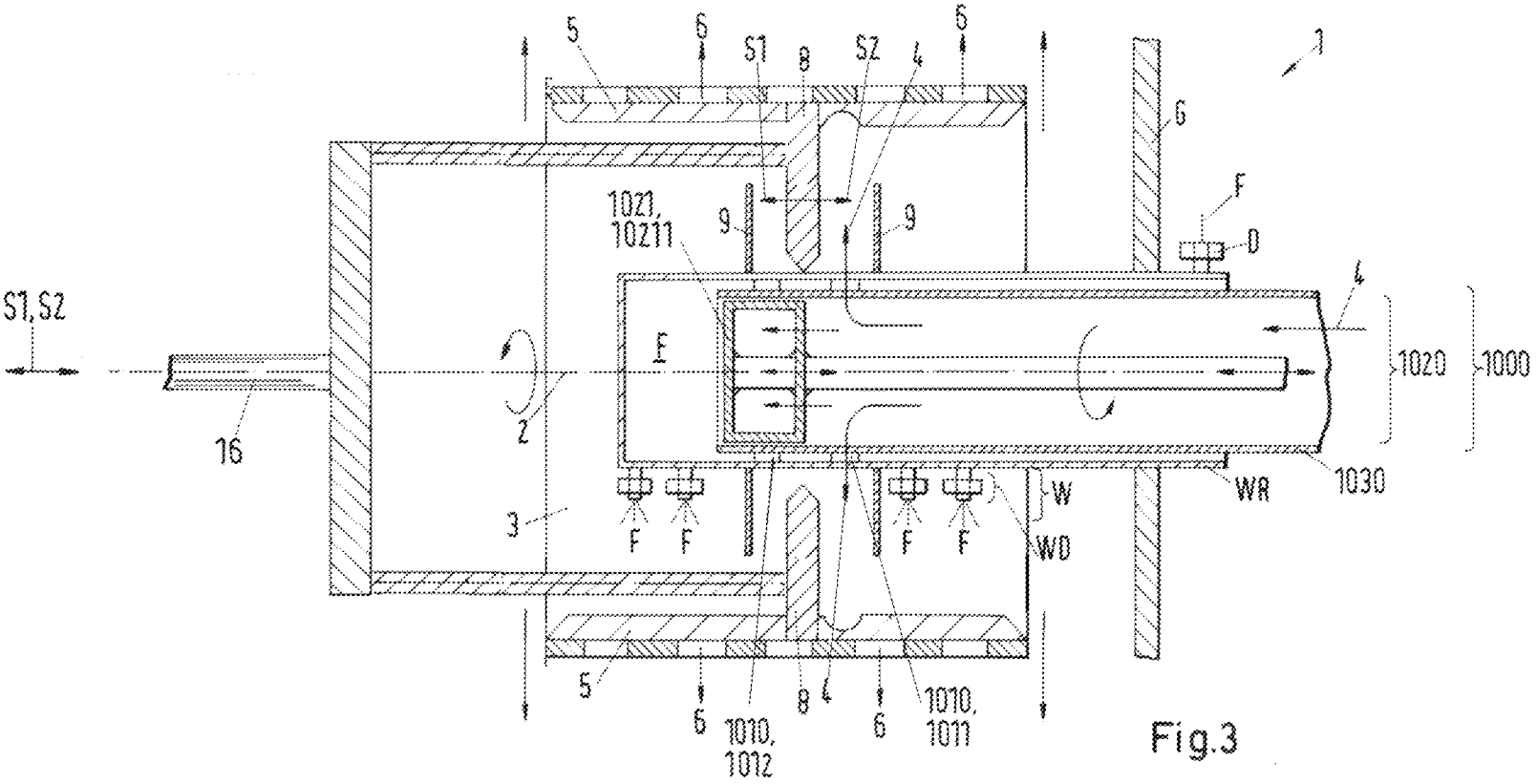
Figure 4A:
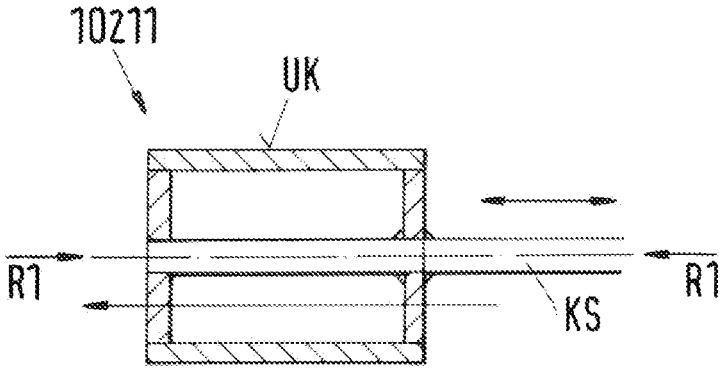
Figure 4B:
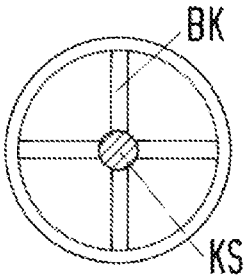
Figure 5:
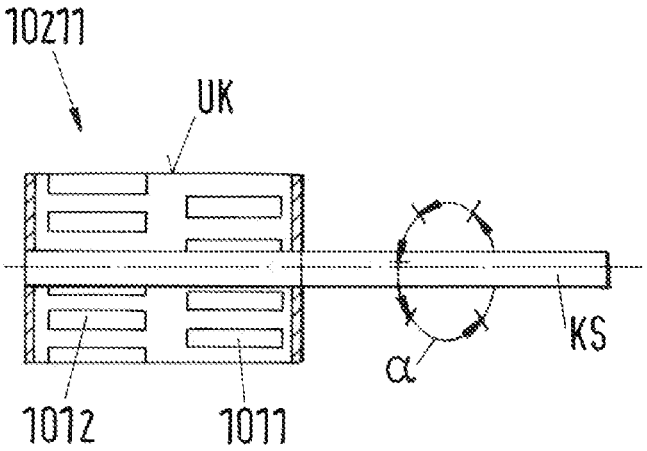

The invention will be explained in more detail in the following with reference to the schematic drawing. There are shown:

FIG. 1 in section, a double-action pusher centrifuge known from the prior art with acceleration surfaces;

FIG. 2 a first embodiment in accordance with the invention without product washing;

FIG. 3 a second embodiment in accordance with the invention with product washing;

FIGS. 4*a*-4*b* a first embodiment of a metering piston;

FIG. 5 a second embodiment of a metering piston; and

Figure 6C:
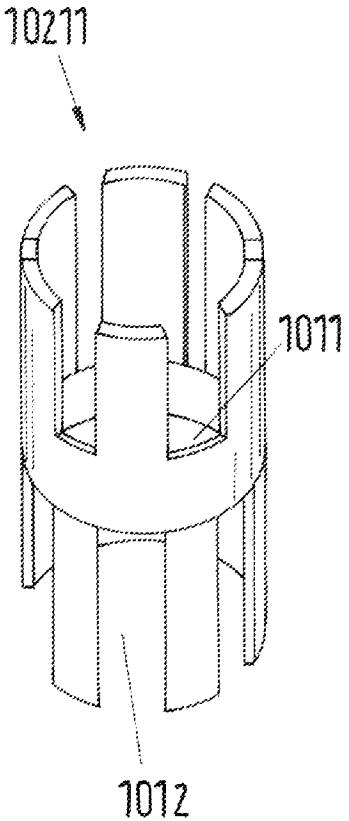
Figure 6B:
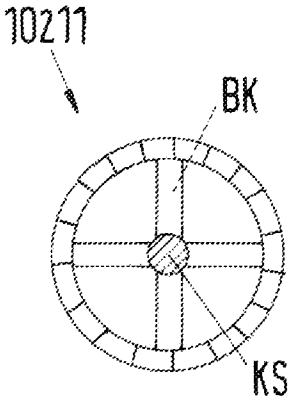
Figure 6A:
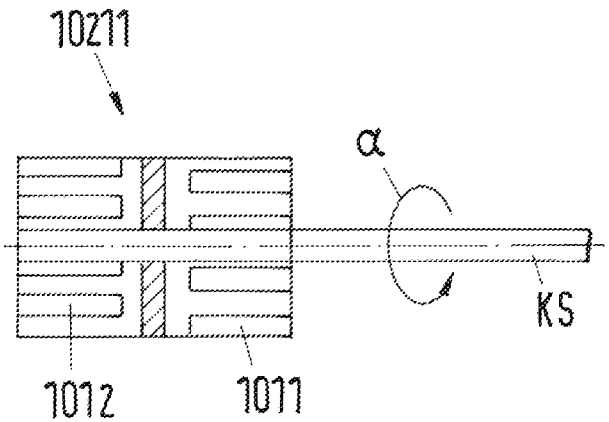

FIGS. 6*a*-6*c* a third embodiment of a metering piston.

FIG. 1 shows a double-action pusher centrifuge known from the prior at in accordance with EP 1 468 741 A1 which was already described in detail above and therefore no longer has to be discussed further at this point.

FIG. 1 shows in section in a schematic representation major components of a centrifuge in accordance with the invention for the special example of a double-action centrifuge which is marked as a whole in the following by the reference numeral 1.

FIG. 2 shows in a schematic representation a first embodiment of a centrifuge in accordance with the invention in an embodiment of a double-action pusher centrifuge without product washing. The double-action pusher centrifuge 1 shown in FIG. 2, which could in principle also be a single-stage or multistage pusher centrifuge or even a scraper centrifuge having a feed device 1000 in accordance with the invention, comprises in a manner known per sea screen drum 3 rotatable about an axis of rotation 2 for separating a mixture 4 into a solid cake 5 and into a liquid phase 6, a pusher base apparatus 8 which is arranged in the screen drum 3 and which is arranged movably to and fro alternately in a first pushing direction S1 and a second pushing direction S2 along the axis of rotation 2, by a pusher axle 16 connected to a pusher apparatus, such that the solid cake 5 is alternately displaceable along the axis of rotation 2. In addition, the centrifuge 1 comprises the feed device 1000 with which the mixture 4 can be introduced into a first empty space 1101 or into a second empty space 1102 which first empty space 1101 can be established on a displacement of the solid cake 5 by the pusher base apparatus 8 in the first pushing direction S1, and the second empty space 1102, which is already filled with mixture 4 in FIG. 2 or FIG. 6 respectively, can be established on a displacement of the solid cake 5 by the pusher base apparatus 8 in the pushing direction S2 opposite to the first pushing direction S1. In accordance with the present invention, the feed device 1000 comprises a feed redirection control 1020 and a mixture supply 1010 so that the mixture 4 can be supplied by means of the feed redirection control 1020 via the mixture supply 1010 to the first empty space 1101 or to the second empty space 1102 in accordance with a predefinable scheme.

The feed device 1000 comprises an inlet pipe 1030 having an inlet pipe axis EA, with the feed redirection control 1020 comprising a metering device 1021, 10211 in an embodiment of a metering piston 10211 provided at the inlet pipe 1030, with the mixture supply being able to be manipulated by the metering device in accordance with a predefinable scheme such that a supply of the mixture 4 into the first empty space 1101 or into the second empty space 1102 is suppressed.

This is effected in the present embodiment of FIG. 2 in that the metering piston 10211 is displaceable in the axial direction along the inlet pipe axis EA and the mixture supply 1010 is simultaneously an integral component of the inlet pipe 1030 in the form of first supply openings 1011 provided at the inlet pipe 1030 e.g. in the form of bore openings, not movable with respect to the inlet axis EA, for the supply of the mixture 4 into the first empty space 1101 and in the form of second supply openings 1012, not movable with respect to the inlet axis E1, for the supply of the mixture 4 into the second empty space 1102. In the operating state, the metering piston 10211 is controlled, for example, via the piston rod KS such that the metering piston 10211 releases the first supply openings 1011 when the pusher base 8 has released the first empty space 1101 by displacement in the direction S1 and in this respect simultaneously closes the second supply openings 1012. In the subsequent reverse stroke of the pusher base 8 in the direction S2, the metering piston 10211 releases the second supply openings 1012 and simultaneously closes the first supply openings 1011 so that the mixture is only supplied to the second empty space 1102. In this respect, an inlet disk 9, such as shown by way of example here, is provided at the inlet tube 1030 for the controlled supply of the mixture 4 into a predefinable region of the screen drum 3 in a manner known per se.

It is self-explanatory that in another embodiment the piston rod KS can be replaced e.g. with a chain or with a cable control with which the metering piston 10211 can be moved or that the piston rod KS can be replaced with a suitable pneumatic, hydraulic, electric or other operational line when the corresponding drive of the metering piston is provided directly at the piston itself or at another point of the redirection control 1020. What was stated above naturally applies analogously to any embodiment of a metering device 1021, 10211, that is e.g. also to a metering bush attached outwardly about the pipe or any other type of movable metering device which, in the simplest case, can also e.g. be a flap movable with respect to the first supply opening 1011 and/or to the second supply opening 1012 or a shutter. The skilled person easily understands the equivalent solutions and possibility for the flexible or controlled release of the supply openings.

A second embodiment of the present invention of great importance for practice is shown schematically with an integrated product washing with reference to FIG. 3. The washing device W for washing the solid cake 5 by means of a washing fluid F here comprises a plurality of washing nozzles WD which are arranged at an outer washing pipe WR of the feed device 1000 such that the washing fluid F can be applied onto the solid cake 5 through the washing nozzles WD for washing it. The feed device 1000 is configured as a double-walled pipe having the outer washing pipe WR and the inlet pipe 1030 arranged therein with a feed redirection control 1020. The mixture 4 is in this respect supplied to the inlet pipe 1030 arranged in the interior in a known manner, whereas the washing fluid F can be supplied via a feed metering unit D which can preferably be controlled and/or regulated to an intermediate space between the outer washing pipe WR and the inner inlet pipe 1030 and from there to the washing nozzles WD of the washing device W. The feed metering unit D is, for example, a valve which can be controlled or regulated such that the washing fluid F ca be supplied to the feed device in accordance with a predefinable scheme and in a predefinable quantity and can thus be applied to the solid cake 5.

It is self-explanatory in this respect that the washing device W can also be configured in a different manner, also in a manner known per se, or that the washing device W can also be substantially identical to the feed device 1000 or part of the feed device 1000 so that, for example, the mixture 4 or the washing fluid F or also a flushing fluid for flushing the interior of the screen drum can be supplied, e.g. after one another or alternately via the feed device.

FIGS. 4*a*-4*b* show a first embodiment of a metering piston 10211 in accordance with FIG. 2 or FIG. 3 a little more exactly in detail, with FIG. 4*b* showing a view of the metering piston 10211 from the direction R1 or R2. As can clearly be seen, the metering piston 10211 is substantially a hollow cylinder which is open at both sides and through which the piston rod KS runs axially in the center which is fastened e.g. at the front and rear end to the outer peripheral surface UK of the metering piston 10211 by a fastening cross BK. When the outer peripheral surface UK e.g. covers the first supply opening 1011, no mixture 4 can thus move through it into the screen drum 3. Conversely, when the metering piston 10211 is displaced along the axial direction S1 until the metering opening 1012 is covered, the mixture 4 can no longer move through the metering opening 1012 into the screen drum 3, but rather e.g. only through the metering opening 1011 into the first empty space 1101. In this manner, the metering of the mixture 4 can be controlled by the metering piston 10211 alternately into the first empty space 1101 and into the second empty space 1102. Since the metering piston 10211 is open at both ends, apart from the fastening cross BK, it can be moved to and fro in the axial direction without any substantial mechanical resistance through the inlet pipe 1030 fully or partly filled with mixture 4.

Further embodiments of a metering piston 10211 are shown with reference to FIG. 5 and to FIGS. 6*a* to 6*c*, the metering piston here being a piston rotatable about the piston rod KS and having metering openings 1011, 1012. Such a rotatable metering piston 10211 can be rotated about the piston rod KS such that the metering openings 1011 or 1012 provided at the metering piston 10211 cooperate with metering openings 1011 or 1012 likewise provided at the inlet pipe 1030 such that mixture 4 can alternately, in dependence on the angle of rotation α, be introduced thought the metering openings 1011 or through the metering openings 1012 into the screen drum 3. The metering piston 10211 in accordance with FIG. 6*a* in this respect differs from that in accordance with FIG. 5 substantially in that the first metering opening 1011 is offset with respect to the second metering opening 1012 by a predefinable angle of rotation α in the peripheral direction and the fastening cross BK in FIG. 6 is arranged at the center of the metering piston 10211, whereas it is provided at the axial ends of the metering piston 10211 in the embodiment in accordance with FIG. 5.

It is self-explanatory in this respect that the previously explained embodiment variants shown schematically in the Figures can also advantageously be combined with one another to form further embodiments to meet specific demands in practice.

The invention claimed is:

1. A centrifuge, comprising:

a screen drum rotatable about an axis of rotation for separating a mixture into a solid cake and into a liquid phase, a pusher base apparatus arranged in the screen drum and configured to be movable to and fro alternately in a first pushing direction and a second pushing direction along the axis of rotation by a pusher axle connected to a pusher apparatus with a redirection control so that the solid cake is alternately displaceable along the axis of rotation, wherein the pusher base apparatus defines a first side and a second side, opposite the first side; and a feed device configured to selectively introduce the mixture into a first empty space and into a second empty space, wherein the first empty space is established on the first side of the pusher base apparatus by a displacement of the solid cake by the pusher base apparatus in the first pushing direction and the second empty space is established on the second side of the pusher base apparatus by a displacement of the solid cake by the pusher base apparatus in the second pushing direction opposite to the first pushing direction, wherein the feed device comprises a feed redirection control and a mixture supply configured so that the mixture is selectively supplied by the feed redirection control via the mixture supply to one of the first empty space or the second empty space.

2. The centrifuge in accordance with claim 1, wherein the feed device comprises an inlet pipe having an inlet pipe axis and the feed redirection control comprises a metering device provided at the inlet pipe, and wherein the mixture supply is configured to be manipulated so that a supply of the mixture into the first empty space or into the second empty space is suppressed.

3. The centrifuge in accordance with claim 2, wherein the metering device is a metering piston arranged at least partly in the inlet pipe.

4. The centrifuge in accordance with claim 2, wherein the metering device is arranged displaceable along the inlet pipe axis or rotatable about the inlet axis.

5. The centrifuge in accordance with claim 2, wherein the mixture supply is an integral component of the inlet pipe and the inlet pipe comprises a first supply opening, not movable with respect to the inlet axis, for the supply of the mixture into the first empty space and a second supply opening, not movable with respect to the inlet axis, for the supply of the mixture into the second empty space.

6. The centrifuge in accordance with claim 2, wherein the mixture supply is an integral component of the metering device and the metering device comprises a first supply opening, movable with the metering device with respect to the inlet axis, for the supply of the mixture into the first empty space and a second supply opening, movable with the metering device with respect to the inlet axis (EA), for the supply of the mixture into the second empty space.

7. The centrifuge in accordance with claim 2, wherein a plurality of mixture supplies or a plurality of metering devices are provided.

8. The centrifuge in accordance with claim 2, wherein a washing device is provided for washing the solid cake by a washing fluid, wherein the washing device is identical to the feed device or to a part of the feed device.

9. The centrifuge in accordance with claim 8, wherein a feed metering unit is provided for the controlled supply of the mixture or of the washing fluid such that a predefinable quantity of the mixture or a predefinable quantity of the washing fluid is supplied to the feed device, and/or wherein an inlet disk is provided, at the inlet pipe, for the controlled supply of the mixture into a predefinable region of the screen drum.

10. The centrifuge in accordance with claim 1, wherein the feed device comprises a plurality of inlet pipes having the feed redirection control and the mixture supply such that the mixture is supplied to the first empty space or to the second empty space.

11. The centrifuge in accordance with claim 10, wherein the mixture is supplied separately by the feed redirection control to at least some of the inlet pipes or to a group of inlet pipes.

12. The centrifuge in accordance with claim 1, wherein the feed redirection control is manipulated by a mechanical drive or of an electrical drive or of a hydraulic drive or of a pneumatic drive.

13. A method of loading a double-action pusher centrifuge in accordance with claim 1 with a mixture or with a washing fluid.

14. The centrifuge in accordance with claim 1, wherein the feed redirection control is manipulated by a mechanical drive or of an electrical drive or of a hydraulic drive or of a pneumatic drive and is controlled or regulated by a control unit.

* * * * *